US012258778B2

(12) United States Patent
Foy

(10) Patent No.: US 12,258,778 B2
(45) Date of Patent: Mar. 25, 2025

(54) ROTOMOLDED SPA AND METHOD OF MANUFACTURING A SPA

(71) Applicant: 9213-4550 QUÉBEC INC., Drummondville (CA)

(72) Inventor: Jérôme Foy, Orford (CA)

(73) Assignee: 9213-4550 QUÉBEC INC., QUEBEC (CA)

( * ) Notice: Subject to any disclaimer, the term of this patent is extended or adjusted under 35 U.S.C. 154(b) by 141 days.

(21) Appl. No.: 18/156,125

(22) Filed: Jan. 18, 2023

(65) Prior Publication Data

US 2023/0228112 A1 Jul. 20, 2023

Related U.S. Application Data

(60) Provisional application No. 63/300,749, filed on Jan. 19, 2022.

(51) Int. Cl.
*E04H 4/00* (2006.01)

(52) U.S. Cl.
CPC ..... *E04H 4/0037* (2013.01)

(58) Field of Classification Search
CPC ... E04H 4/0018; E04H 4/0031; E04H 4/0037; E04H 2004/0068
See application file for complete search history.

(56) References Cited

U.S. PATENT DOCUMENTS 8,881,321 B1 * 11/2014 Ludlow ..... E04H 4/0037 4/506
11,702,854 B2 * 7/2023 Foy ..... E04H 4/0037 4/506
12,090,116 B2 * 9/2024 Foy ..... A61H 33/0087
2018/0243165 A1 * 8/2018 Koops ..... A61H 33/6005

FOREIGN PATENT DOCUMENTS

FR 2880373 A1 * 7/2006 ..... E04H 4/0031

* cited by examiner

*Primary Examiner* — Erin Deery
(74) *Attorney, Agent, or Firm* — NORTON ROSE FULBRIGHT CANADA LLP

(57) ABSTRACT

There is disclosed a spa. The spa generally having a unibody shell having a basin, a rim portion surrounding the basin, a peripheral wall extending from the rim portion, and at least one opening in the peripheral wall, the basin, the rim portion and the peripheral wall defining a cavity therebetween, the at least one opening exposing the cavity; and a frame structurally mounted within the cavity, the frame having a crossbar and a plurality of strut members extending from the crossbar, the crossbar and the plurality of strut members running along respective sides of the at least one opening, the plurality of strut members each being affixed to the unibody shell at locations distributed about the at least one opening.

15 Claims, 11 Drawing Sheets

ROTOMOLDED SPA AND METHOD OF MANUFACTURING A SPA

TECHNICAL FIELD

The improvements generally relate to the field of spas, and more specifically to spas having a rotationally-molded shell.

BACKGROUND OF THE ART

Spas, alternatively referred to as portable spas, hydrotherapy spas or hot tubs may be found in various shapes, sizes and types. Spas can be classified on the basis of their method of manufacture. Some spas may have a basin made by rotational molding, also known as rotomolding. Rotomolded spas have several advantages, and have been satisfactory to a certain degree, but there always remains room for improvement. For instance, the rotomolding fabrication process may cause certain challenges in terms of providing structure to the molded part while also achieving secondary objectives such as molding efficiency and total amount of plastic material used, etc., the latter affecting the costs significantly. On a structural aspect, not only should the overall structure of the spa be adapted to withstand, sporadically and over time, the weight of the contained water and of the bathers, but especially in cold climates, the structure may have to support the weight of a spa cover/hood. The rim portion of the spa, often already loaded with the weight of the water in the basin, and where user(s) may step or lean on to enter or exit the basin, may be particularly vulnerable to deformation. When loaded or simply during use, the top portion of the basin, which may form at least part of the rim portion of the spa, may warp from its original profile, which may cause undesirable stress to the molded part, improper sealing with a spa cover and associated energy inefficiencies, premature failure of the material of the molded part and/or an overall unappealing and/or non sturdy look. All these factors may militate in favor of over-designing the rotomolded component's structure.

SUMMARY

In accordance with one aspect, there is provided a spa comprising: a unibody shell having a basin, a rim portion surrounding the basin, a peripheral wall extending from the rim portion, and at least one opening in the peripheral wall, the basin, the rim portion and the peripheral wall defining a cavity therebetween, the at least one opening exposing the cavity; and a frame structurally mounted within the cavity, the frame having a crossbar and a plurality of strut members extending from the crossbar, the crossbar and the plurality of strut members running along respective sides of the at least one opening, the plurality of strut members each being affixed to the unibody shell at locations distributed about the at least one opening.

In accordance with another aspect, there is provided a method of manufacturing a spa, comprising: rotomolding a unibody shell of the spa, the unibody shell having a side portion; defining at least one opening in the side portion of the unibody shell; inserting a plurality of strut members and a crossbar, within a cavity circumscribed by the unibody shell and exposed by the at least one opening; affixing the plurality of strut members and the crossbar to one another, collectively forming a frame; and affixing the frame to the unibody shell about the at least one opening.

Many further features and combinations thereof concerning the present improvements will appear to those skilled in the art following a reading of the instant disclosure.

DESCRIPTION OF THE DRAWINGS

FIG. 9 is a sectional view of the base of FIG. 8, viewed from the inside of the spa, in accordance to one or more embodiments.

DETAILED DESCRIPTION

Figure 1:
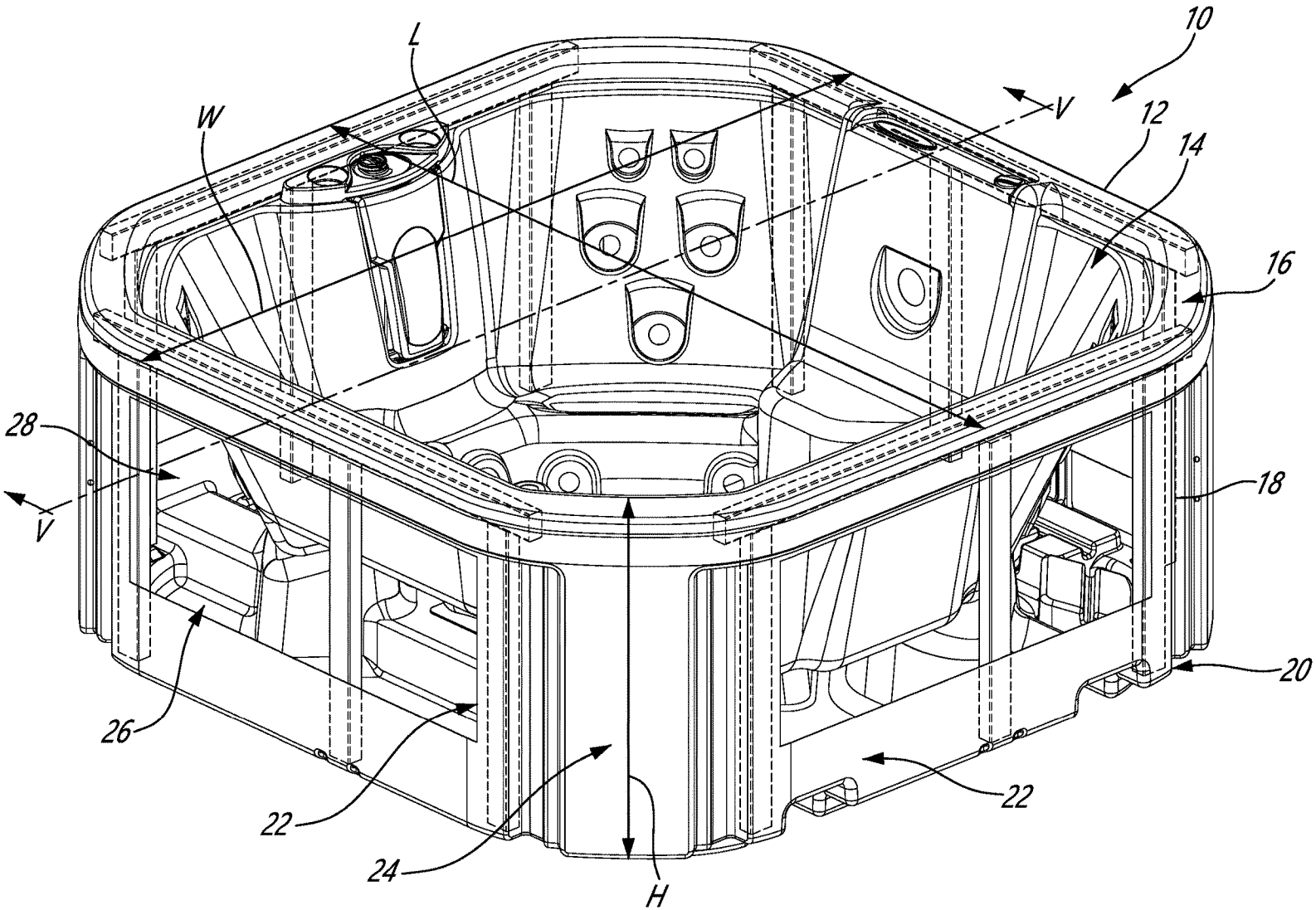
FIG. 1 is an oblique view of an example of a spa, shown with uncovered openings in side portions of the spa and a hidden frame system in dashed lines, in accordance to one or more embodiments.

FIG. 1 shows an exemplary spa 10, including a rotomolded unibody shell 12. The unibody shell 12 defines interior surfaces of the spa 10 and exterior surfaces of the spa 10 which may contribute to the structural rigidity of the spa 10 by their continuous and complex geometry when viewed as a whole. The unibody shell 12 may define ribs, ridges, grooves, undulations, recesses, corners and/or other protrusions or reliefs at selected locations in order to define rigidifying features of the shell 12.

As depicted, the shell 12 defines a basin 14 to receive water and bathers. The geometry of the basin 14 may define seat rest(s), armrest(s), headrest(s) jet opening(s) and/or cavities opened towards the interior of the basin 14. As depicted, the shell 12 defines a rim portion 16 at a top of the basin 14. The rim portion 16 may define a peripheral outline of the spa 10 at an upper end thereof. The rim portion 16 may receive portions of a spa cover/hood (not shown). In some embodiments, the rim portion 16 defines an uppermost surface of the shell 12 and faces upwardly, at least along part thereof. In this example, the rim portion 16 has a generally flat surface (e.g., with ±10° of inclination or slightly angled, domed or rounded). The shell defines a peripheral wall 18 and a base 20. The peripheral wall 18 extends from the rim portion 16 downwardly towards the base 20. The peripheral wall 18 may extend generally vertically (e.g., ±10°), though it could be skewed in other embodiments. The base 20 extends under the basin 14. The base 20 may include ridges or other reliefs, compared to a flat panel or the like, for greater rigidity. The base 20 may interface with the ground surface. The base 20 may have a surface (e.g., a continuous surface) or surface portions adapted to contact the ground and/or support surface upon which the spa 10 may be installed. The unibody shell 12 may define a self-supporting structure, meaning that the unibody shell 12 may support its own weight and/or maintain its shape without additional components. In some cases, a spa such as spa 10 with a unibody shell having a base such as base 20 may be portable and maintain its structural integrity and shape, even during handling and lifting, it can stand by itself on a level surface.

In this example, the spa 10 has a generally rectangular shape, in spite of its angled and/or curved corners. The spa 10 includes side portions 22 which may be substantially planar over most if not all of their lateral dimension in a peripheral direction of the spa 10, and corner portions 24, which may be curved or angled, of the shell 12 at the intersection of two side portions 22. As shown, corner portions 24 are formed on each lateral side of a side portion 22. Preferably, all the corner portions 24 are arced approximately 90° with a constant radius of curvature. More preferably, the corner portions 24 can be part of a same circle which are cut between one another by the side portions 22. As shown, while the corner portions 24 contribute to a lateral dimension defining portions of the periphery of the spa 10, the side portions 22 are considered the main sides of the spa 10 in that the side portions 22 may have between 2 to 5 times the lateral dimension of the corner portions 24, for example. It is understood that in alternative embodiments, rounded side portions or spa shapes with more or less sides, e.g., three, five, six sides forming other geometrical shape may also be contemplated. In some embodiments, spas 10 may have a custom shape, adapted to fit to a given outdoor or indoor setup.

The peripheral wall 18 defines a windowed structure of the spa 10. The side portions 22 are defined in part by the peripheral wall 18. As shown, the side portions 22 include openings 26, giving access to a cavity 28 defined between the basin 14 and the peripheral wall 18 as well as between the basin 14 and the base 20. In other words, the rim portion 16, the peripheral wall 18 and optionally the base 20 collectively define the cavity 28. The openings 26 may be sized identically or differently, depending on the embodiments. In the example shown, the openings 26 extend along a substantial extent of the side portions 22. The openings 26 may extend over between 50% and 90%±10% of the overall width W (or length L) of the spa 10, preferably 50% to 80% of the overall width W (or length L), more preferably 60% to 80% of the overall width W (or length L) or even move preferably 75%±10% of the overall width W or length L. The openings 26 may extend over between 50% and 95% of the overall height H of the shell 12 (measured from a bottom of the base 20 to a top of the rim portion 16), more preferably between 60% and 95% of the overall height H and more preferably between 75% and 95% of the overall height H of the shell 12. It may be desired to maximize a dimension (lateral and heightwise) of the openings 26 to facilitate access to the cavity 28, for maintenance, installation, verification of the enclosed equipment, for example.

Figure 1A:
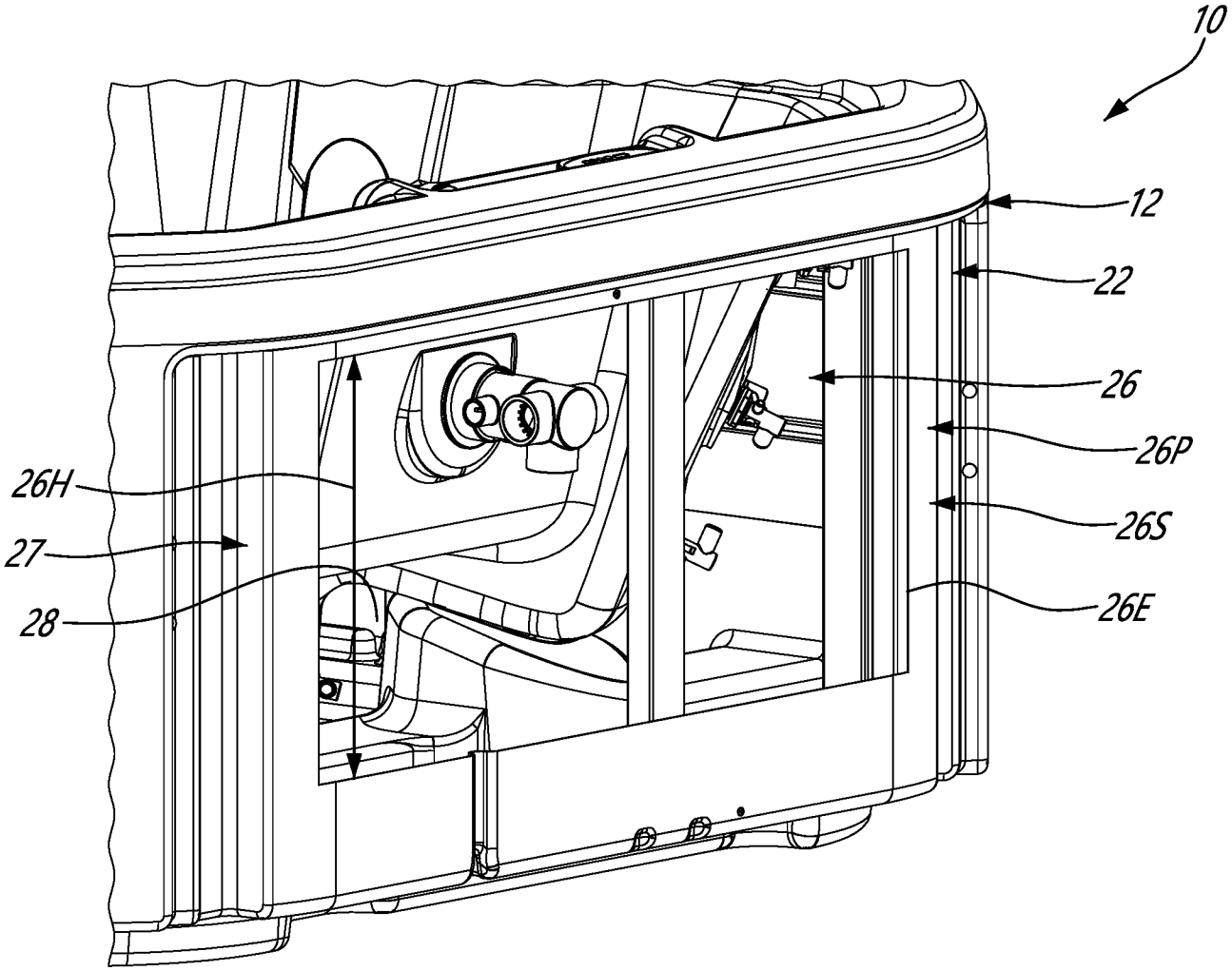
FIG. 1A is an enlarged view of a side portion of the spa of FIG. 1, showing an uncovered opening leading to a cavity within the spa, in accordance with one or more embodiments.

A magnified view of a side portion of the spa 10 is shown at FIG. 1A. In this view, it may better be seen that a periphery 26P of the opening 26 of the side portion 22 includes a flat surface 26S extending from a lateral edge 26E of the opening 26. Such flat surface 26S surrounding the opening 26 may interface with a back of a decorative panel, which is discussed later. The flat surface 26S extends in a peripheral direction (i.e., horizontal direction) of the spa 10 to a receding corner 27 defined in the shell 12 on opposite, lateral sides of the opening 26. As depicted, the receding corner 27 recedes inwardly towards the cavity and extends vertically parallel to a height of the opening 26. As illustrated, the receding corners 27 extend upwardly along the full height 26H of the opening 26, and beyond, towards the rim portion 16 and the base 20. Such receding corners 27 may add structural integrity to the shell 12. The receding corner 27 is opened outwardly relative to the spa 10. In other words, the receding corners 27 protrude towards the cavity 28, leaving a concave depression as viewed from the exterior of the spa 10. As shown, the flat surface 26S extending from the lateral edge 26E of the opening 26 extends in a plane offset outwardly with respect to the receding corners 27.

Figure 2:
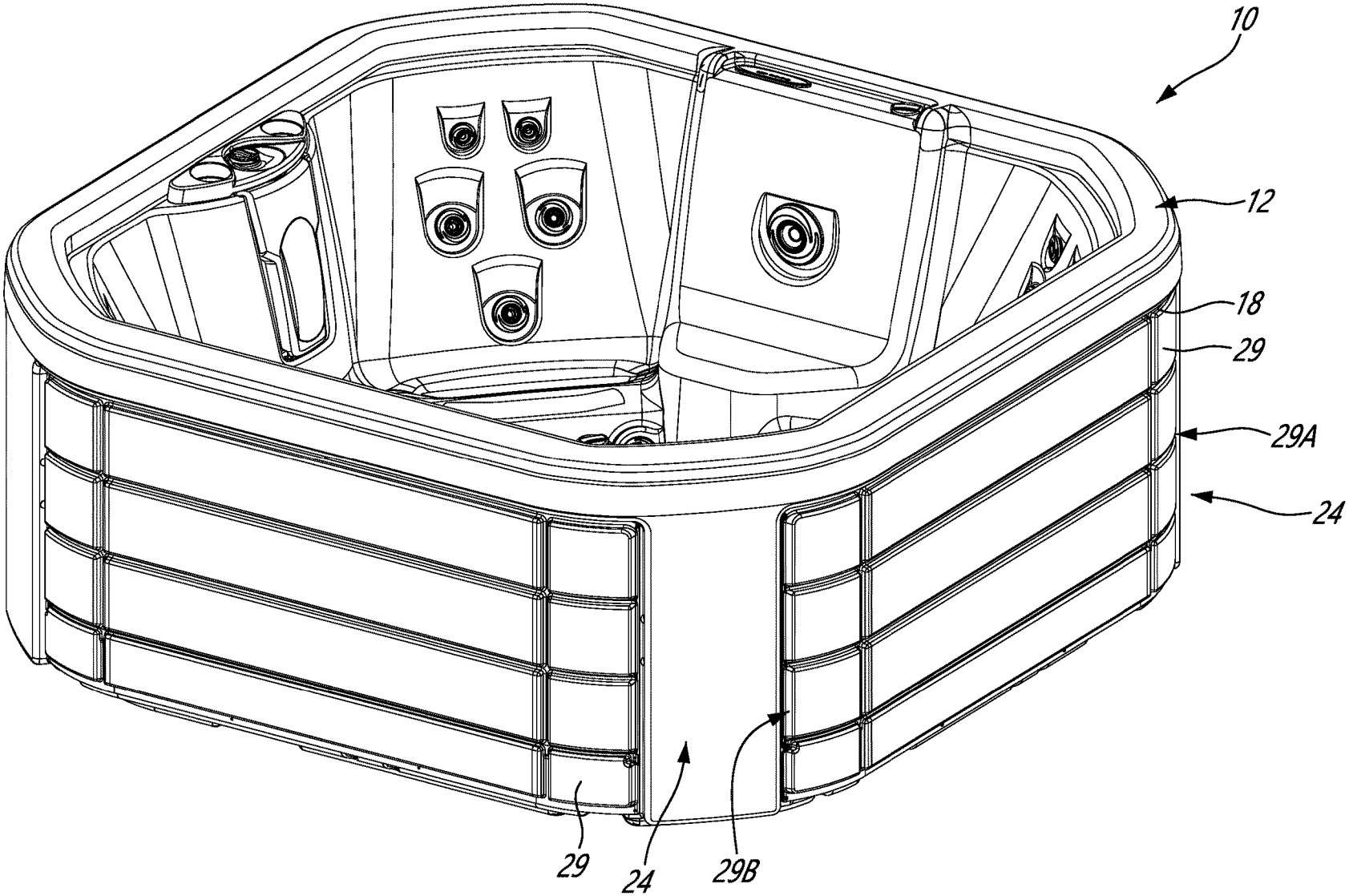
FIG. 2 is an oblique view of the spa of FIG. 1, shown with panels covering respective openings in the side portions of the spa, in accordance to one or more embodiments.

As shown in FIG. 2, the openings 26 (not apparent) are closable with panels 29 removably secured to the peripheral wall 18. In other words, the panels 29 can cover the openings 26 Such panels 29 may provide additional rigidity to the peripheral wall 18 in spite of the openings 26 defined therein. The panels 29 have a planar outer surface. In this example, the panels 29 have horizontal ribs defined therein. The opposite ends 29A of the panels 29 are curved to follow the outline of the corner portions 24. The opposite ends 29A are engaged in the receding corners 27 (not apparent) of the shell 12 (described above). Such panels 29 may have, primarily, a decorative/ornamental purpose and/or serve to close or seal the access to the cavity 28 to protect internal components, such as the equipment pack, electrical wiring, plumbing, fittings, water heater, filtration system, etc., from undesirable contaminants, objects, and/or prevent or limit access to the cavity 28 for insects, vermin, etc. For instance, in some embodiments, the panels 29 may be sealingly engaged with the windowed peripheral wall 18 for such purpose. Fasteners, such as screws, clips, etc. and/or interlocking features, for instance, may be contemplated to secure the panels 29 onto the peripheral walls 18.

In at least some embodiments, the inherent rigidity, material, and/or construction of the panels 29 may not provide enough rigidity to compensate for the removal of material to define the windowed peripheral wall 18.

As indicated above, large openings 26 in the side portions 22 may facilitate access to the cavity 28, for maintenance, installation, verification of the enclosed equipment, such as the equipment pack, electrical wiring, plumbing, fittings, water heater, filtration system, etc., which may be wholly or partially within the cavity 28. To obtain a superior structural integrity of the spa 10 and/or compensate for the structural weakening of the shell 12 which may result from the presence of such large openings 26 (weakening compared to inherent mechanical properties of a unibody shell without such openings 26), a frame enclosed within the cavity 28 is acceptable to a certain extent. However, limited space to insert such frame within the cavity 28 of the spa 10 via the openings 26 may be limiting on the size and/or geometry of such frame, and/or ease of assembly. As will be discussed below, providing a plurality of frames 30, which may together be referred to as a frame system, affixed to the unibody shell 12 and decoupled one with respect to each other, in the form of a plurality of individual frame members insertable into the cavity 28 within the shell 12 via the openings 26, may provide structure to a windowed rotomolded spa. On a manufacturing standpoint, rotomolding large shell components such as the shell 12 with a thick wall of material (e.g., polyethylene, such as high density polyethylene—HDPE) such as about % inches thick walls may allow a limited control a uniform thickness or a obtain a precise thickness of material at selected locations of the shell 12. Rotomolding of such a thick shell 12 may not provide a satisfying level of precision on the contemplated stiffness of the shell 12 at least in some areas, when a minimal quantity of material for manufacturing optimization is at play.

Figure 3:
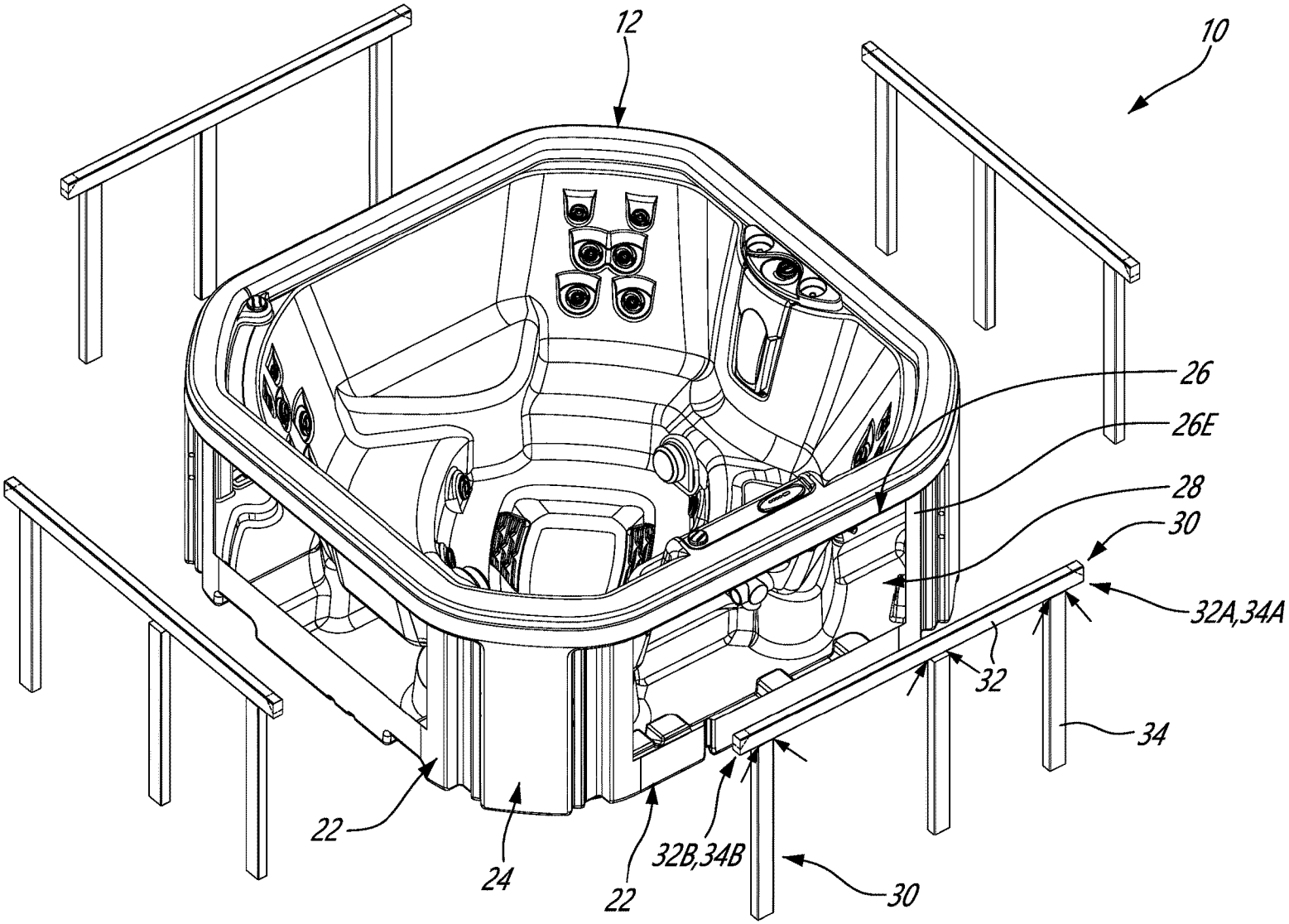
FIG. 3 is an exploded view of the spa of FIG. 1, in accordance to one or more embodiments.

Referring to FIG. 3, the unibody shell 12 includes a plurality of frames 30 within the cavity 28 of the shell 12. The frames 30 are structurally mounted within the cavity via corresponding ones of the openings 26. As can be seen, each frame 30 includes at least a crossbar 32 extending generally horizontally (e.g., at about ±5°) relative to a level floor or surface and a plurality of strut members 34, which may be referred to as posts, pillars, uprights, for instance, depending from the crossbar 32. As shown, in at least some embodiments, the strut members 34 may extend perpendicularly to the crossbar 32 (e.g., at about 90°±5°). The strut members 34 may be parallel to each other, though other relative orientation may be contemplated in other embodiments. The crossbar 32 and the strut members 34 collectively form a frame 30. Features of one such frame 30 and parts are described below.

As depicted, the crossbar 32 and the strut members 34 are sized and shaped to be insertable through the opening 26 and placed along respective edges of the opening 26. During the manufacturing of the spa 10, the crossbar 32 and the strut members 34 may be inserted individually within the cavity 28 via the opening 26, and affixed together once inside the cavity 28. Interferences and/or space constraints may limit the preassembling of the crossbar 32 and the strut members 34 before inserting them into the cavity 28 through the opening 26 in most if not all cases. The strut members 34 are affixed to the crossbar 32 so as to define a rigid connection therebetween. Such rigid connection may be obtained for instance by fasteners, adhesive, interlocking, fastening, a combination of that, or in other suitable ways. Fasteners, such as screws, nails, inserts, dowels pins, and/or adhesives may be contemplated to affix the crossbar 32 and strut members 34 to one another. The crossbar 32 and strut members 34 may also have interlocking features, complementary connectors or else, to facilitate alignment therebetween during assembly. The small arrows in FIG. 3, show suggestions of locations where between the crossbar 32 and the strut members 34 can be preferably affixed to one another. As can be seen at least in FIG. 3, the frames 30 of the frame system are not joined in between them. In other words, the frames 30 remain decoupled from one another. Still, the frames 30 are structurally mounted within the cavity 28 via a corresponding one of the openings 26. Access to the cavity 28 in the corner portions 24 to join the frames 30 together may not be possible or may be cumbersome. The frames 30 may thus be spaced apart from each other at least for this reason.

The crossbar 32 and strut members 34 are affixed together to form in combination a window frame extending along respective sides of the opening 26. As shown, two strut members 34 are positioned adjacent opposite extremities 34A, 34B of the crossbar 32. As such, the two strut members each extend from the crossbar 32 at a respective one of the first and second extremities 34A, 34B of the crossbar 32. In the example shown, the frame 30 includes more strut members 34 than lateral edges of the opening 26, as the opening 26 has two opposite lateral edges and the frame 30 has three strut members 34. As shown, a middle one of the strut members 34 can run across the opening 26. As such, the middle strut member can extend from a center of off-centre position of the crossbar 32. The middle strut member can be centered relative to the opening 26 of be off-center, depending on the embodiment. There could be more than one in other embodiments. In at least some embodiments, such one or more strut members 34 extending across the opening 26 at a distance between the lateral edges of the opening 26 may limit a bending (visually detectable or at the level of micro deformations) of the crossbar 32 when the rim portion 16 of the shell 12 is loaded and/or better distribute a load on the base 20, at more locations corresponding to the number of strut members 34.

In the illustrated embodiment, the extremities 34A, 34B of the crossbar 32 have respective beveled ends 32A, 32B. The beveled ends 32A, 32B may facilitate the insertion of the crossbar 32 in place in the cavity 28, considering various possible interferences the crossbar 32 may have during assembly in the cavity 28. For instance, the beveled ends 32A, 32B can be of use in the insertion of the crossbar 32 through the openings 26 into the cavity 28. In this particular embodiment, the crossbar 32 has a length with is greater than that of the lateral dimension OW of the openings 26. As such, the beveled ends 32A, 32B may aid in the diagonal insertion of the crossbar 32 into the cavity 28, by permitting one of the beveled ends 32A, 32B to be closer to an internal surface when the crossbar 32 is at an angle. Further details of the beveled ends 32A, 32B will be provided below. It is understood that the example use of the beveled ends 32A, 32B are not to be construed as limiting in any way and that such beveled ends 32A, 32B may be absent in at least some other embodiments.

Figure 4:
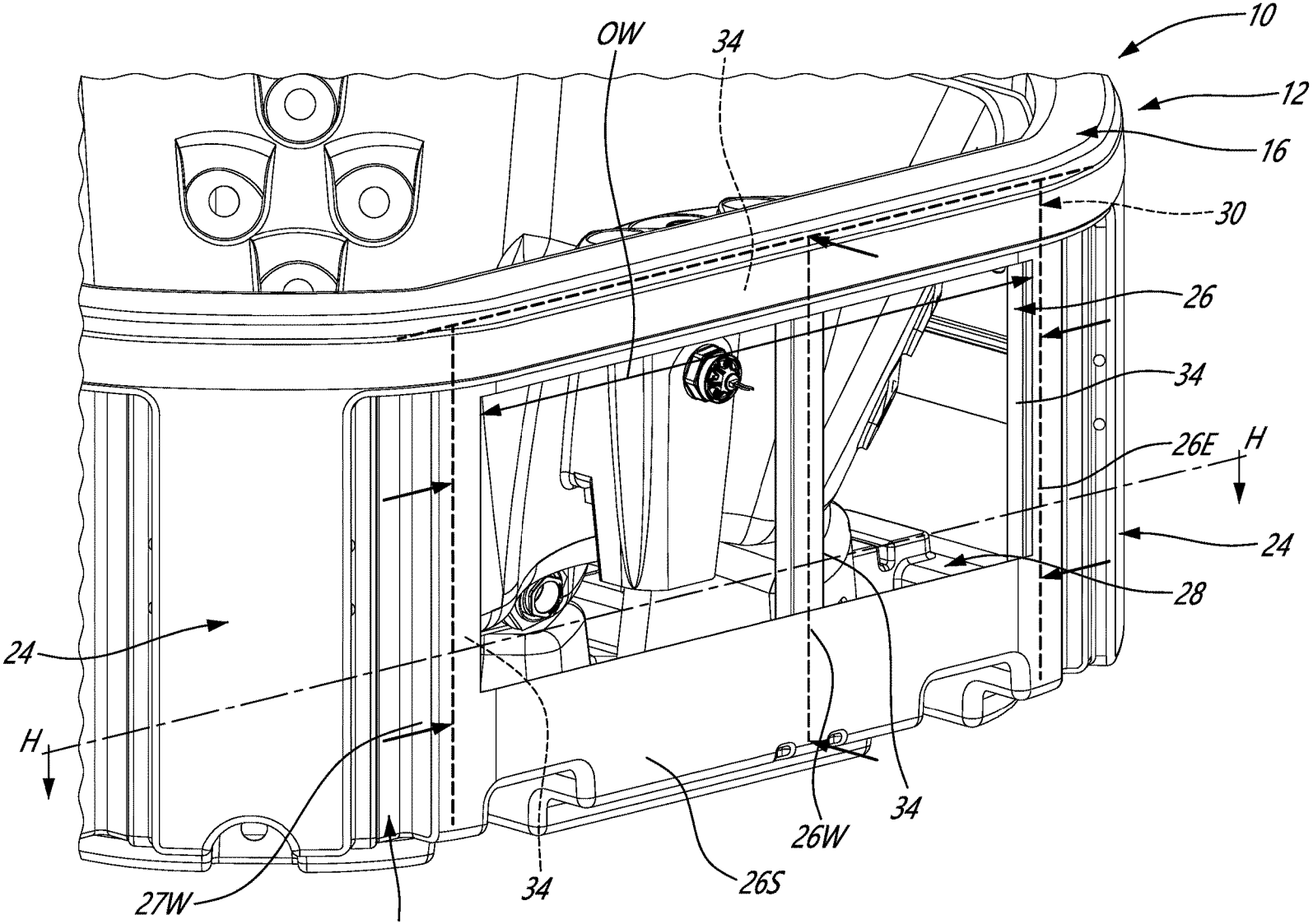
FIG. 4 is an oblique view of the side portion of the spa of FIG. 1, showing a frame in dashed lines, in accordance to one or more embodiments.

As best shown in FIG. 4, the lateral dimension OW of the openings 26 extends over a substantial portion of the side portions 22. Accordingly, the strut members 34 extending across the opening 26 may rigidify even more the rim portion 16. In other words, the frame 30 can provide a structural support for a whole side of the spa 10, between two adjacent corners 24.

As shown, the frame 30 surrounds at least partially the opening 26 defined in the side portions 22 of the spa 10. The crossbar 32 and strut members 34 are affixed together to form in combination a window frame extending along respective sides of the opening 26. The frame 30 is affixed to the shell 12. The frame 30 and portions of the shell 12 on which the frame 30 is affixed may form a composite structure, with the frame 30 and shell 12 contributing to the structural integrity of the spa 10 under load (e.g., water, users, spa cover/hood, or other external loads applied to the overall self-supporting structures of the spa 10).

As shown, the crossbar 32 runs alongside the rim portion 16. At least some of the strut members 34 extend along opposite lateral edges 26E of the opening 26. The crossbar 32 and the strut members 34 may reduce bulking, warping or other undesirable deformation of the peripheral wall 18 extending around the opening 26, for easier installation and/or better fit of the panel 29 (not shown in FIG. 4) onto the peripheral wall 18. Planarity of a contact interface between the panel 29 and the peripheral wall 18 may be more consistent over time by the increased rigidity of the peripheral wall 18 about the opening 26 via the frame 30.

Figure 5:
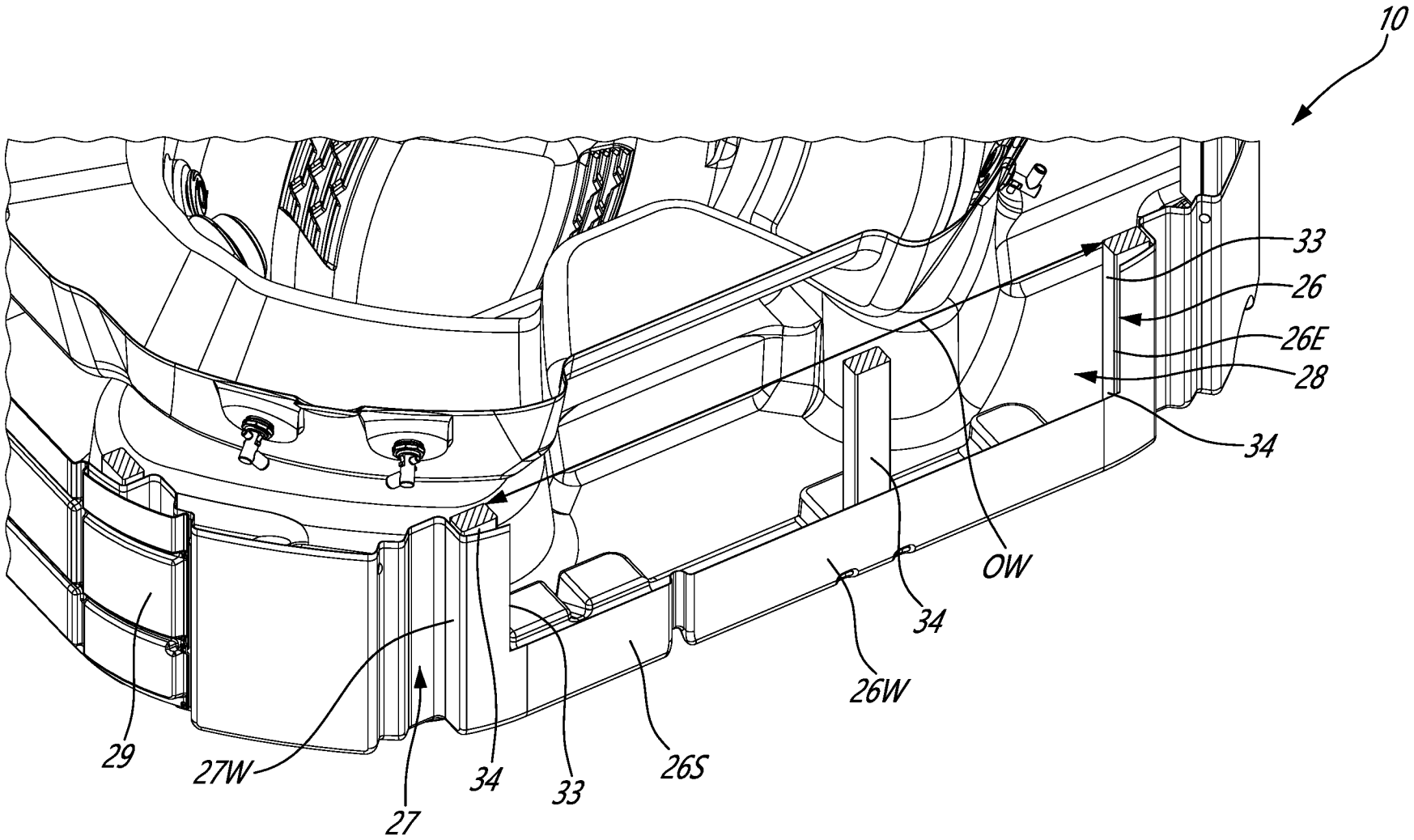
FIG. 5 is a cross-sectional view the spa of FIG. 1, taken along plane H-H of FIG. 4, in accordance to one or more embodiments.

The strut members 34 are affixed to the shell 12 at one or more location thereof. The arrows on FIG. 4 show exemplary locations where the strut members 34 may be affixed to the shell 12. Broadly put, the crossbar 32 and the strut members 34 are preferably affixed to the shell 12 at locations distributed about the respective opening 26. In this example, the crossbar 32 can be abutted against an inner surface of the rim portion 16 of the shell 12. Fasteners, such as screws may be used to affix the strut members 34 to the shell 12 in at least some embodiments. Other fasteners, such as nails, and/or adhesives may be contemplated. Affixing may be made over a surface area, with an adhesive, instead of or in addition to punctual locations such as with fasteners. Referring to FIG. 5, which shows a cross-section of the spa 10 taken in a horizontal plane such as shown at section H-H of FIG. 4, affixing of the strut members 34 extending along lateral edges of the opening 26 may be made between a upwardly extending wall 27W of the receding corners 27. Those strut members 34 may contact or extend in proximity with such wall 27W, rendering such wall 27W one possible affixing interface with the frame 30. A wall 26W defining the flat surface 26S of the window frame surrounding the opening 26 may also be another possibility, in addition to or instead of the wall 27W. However, in some cases, such as shown, such wall 26W may not be close enough from a side surface of the strut member for affixing thereto. In FIG. 4, the strut member extending across the opening 26 in a top-to-bottom direction is affixed at opposite ends thereof, on the wall 26W defining the flat surface 26S of the window frame surrounding the opening 26. In embodiments where fasteners are used, the strut member extending across the opening 26 in a top-to-bottom direction extends through the flat surface 26S and the fasteners affixing the strut members 34 to the upwardly extending wall 27W of the receding corners 27 may extend through such wall 27W. While the use of fasteners extending through surfaces of the shell 12 may make an unappealing look viewed from the exterior, such area may be entirely covered by the panel 29 so as to hide all fasteners, as can be seen in FIG. 5.

It may be desirable to minimize a distance between the strut member and the lateral edge 26E of the opening 26. Still referring to FIG. 5, the strut members 34 along the lateral edges of the opening 26 are slightly outwardly offset away from the lateral edge 26E on the sides of the opening 26. In other embodiments, an inner face of the strut members 34 may coincide and align with the lateral edge 26E on the sides of the opening 26. In all cases, the strut members 34 are placed within the cavity 28 adjacent to the flat surface 26S surrounding the opening 26 and extending along the height H of the spa. As depicted, the strut members 34 are substantially hidden from a viewer looking through the opening 26 into the cavity 28. In some embodiments, inner sides 33 of the strut members 34, facing each other on opposite sides of the opening 26, are aligned with the lateral edge 26E of the sides of the opening 26, extending generally vertically along the height H of the spa. In at least some embodiments, the distance between the strut members 34 on the sides of the opening 26 may be smaller than 110% of the lateral dimension OW of the opening 26. In another embodiment, the distance between the strut members 34 along the lateral edges of the opening 26 is about 1.005 times the lateral dimension OW of the opening 26. In some embodiments, this may correspond to a minute offset between the side of the strut member and the lateral edge 26E of the opening 26.

Figure 6:
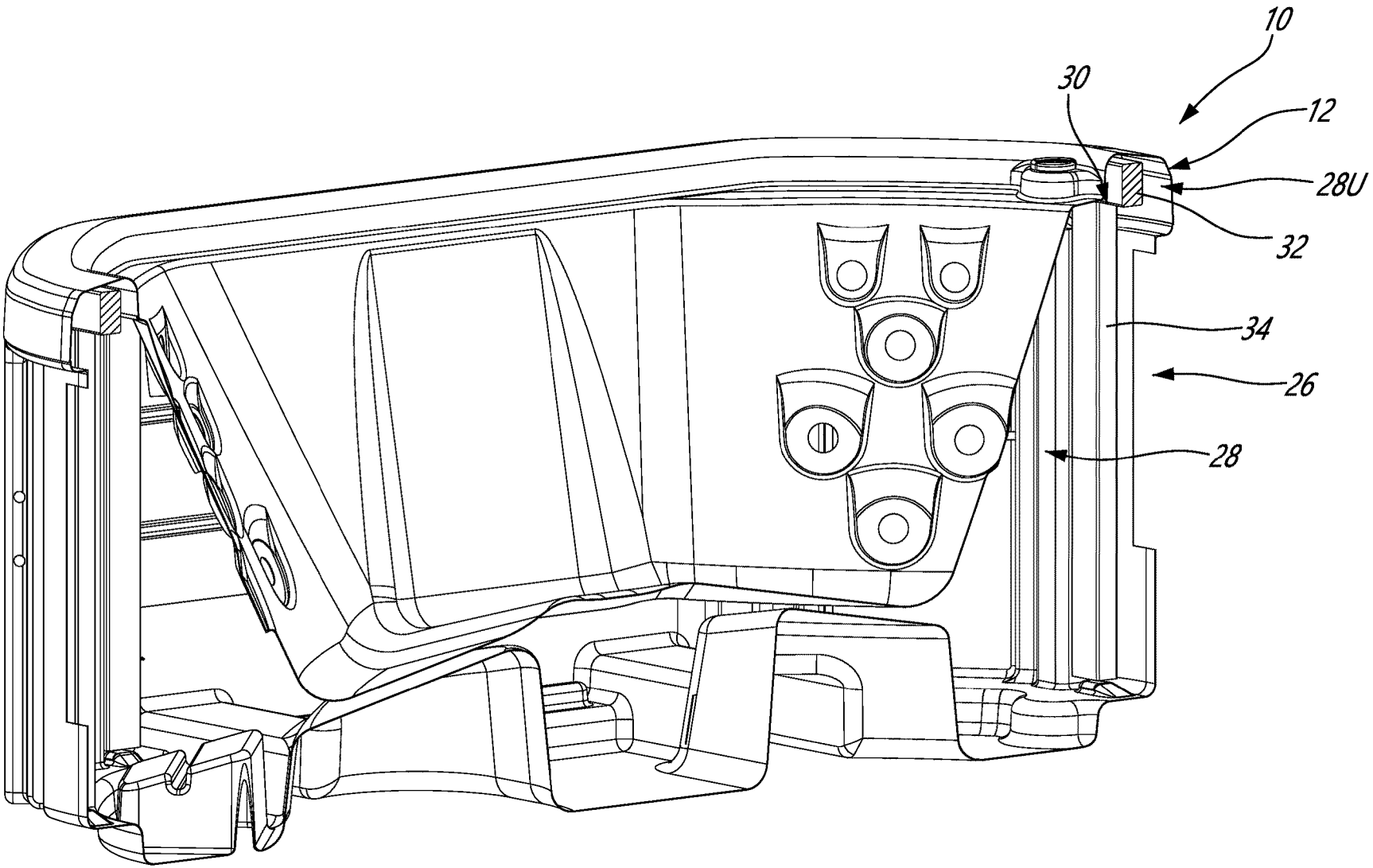
FIG. 6 is a cross-sectional view of the spa of FIG. 1, taken along plane V-V of FIG. 1, in accordance to one or more embodiments.
Figure 7:
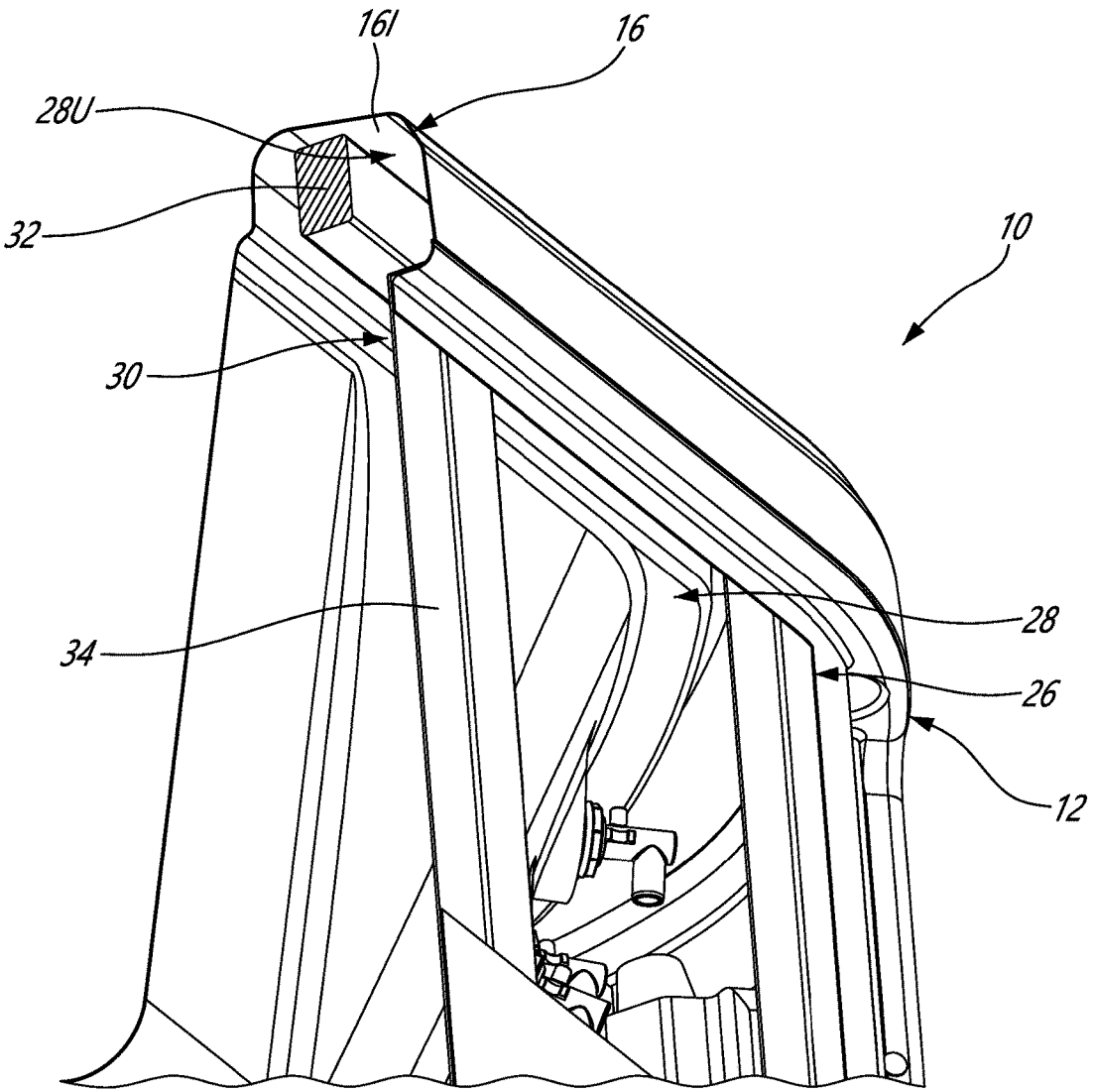
FIG. 7 is a sectional view of a top of the spa of FIG. 1, showing an abutment between a crossbar and an interior of a rim portion of the spa, in accordance to one or more embodiments.

Referring to FIGS. 6 and 7, the crossbar 32 and strut members 34 of respective frames 30 on opposed sides of the spa 10 are partially shown. As described above, the crossbar 32 and the strut members 34 extend along a respective sides of the openings 26. In at least some embodiments, the crossbar 32 contacts an inner surface 16I of the rim portion 16 facing the cavity 28. The crossbar 32 may maintain or contribute to the planarity of the rim portion 16 of the shell 12, in embodiments where the panels 29 and/or the rim portion 16 may not provide enough structural integrity to the shell 12 about the openings 26. Such planarity may provide a better sealing between the spa cover/hood on the rim portion 16 and/or support additional load which may result from snow or ice accumulations on the spa cover/hood during winter use, for example. There may be a gap therebetween in other embodiments to allow for a difference in thermal expansion of the material of the shell 12 and the frames 30, in embodiments where the thermal expansion and/or material of the shell 12 and frames 30 are different.

As shown in FIG. 6 and also referring to FIG. 7, the crossbar 32 is adapted to be lodged in a space 28U of the cavity 28 defined above the opening 26, within the rim portion 16. More specifically, the crossbar 32 is abutted against an inner surface 16I of the rim portion 16 of the shell 12. The crossbar 32 may be located closer to an upper edge of the opening 26 in other embodiments, as another possibility. In embodiments where the dimensions of the crossbar 32 may permit, the crossbar 32 may contact the inner surface 16I of the rim portion 16 and also extend close to the top edge of the opening 26, such as described above with respect to the strut members 34.

Figure 8:
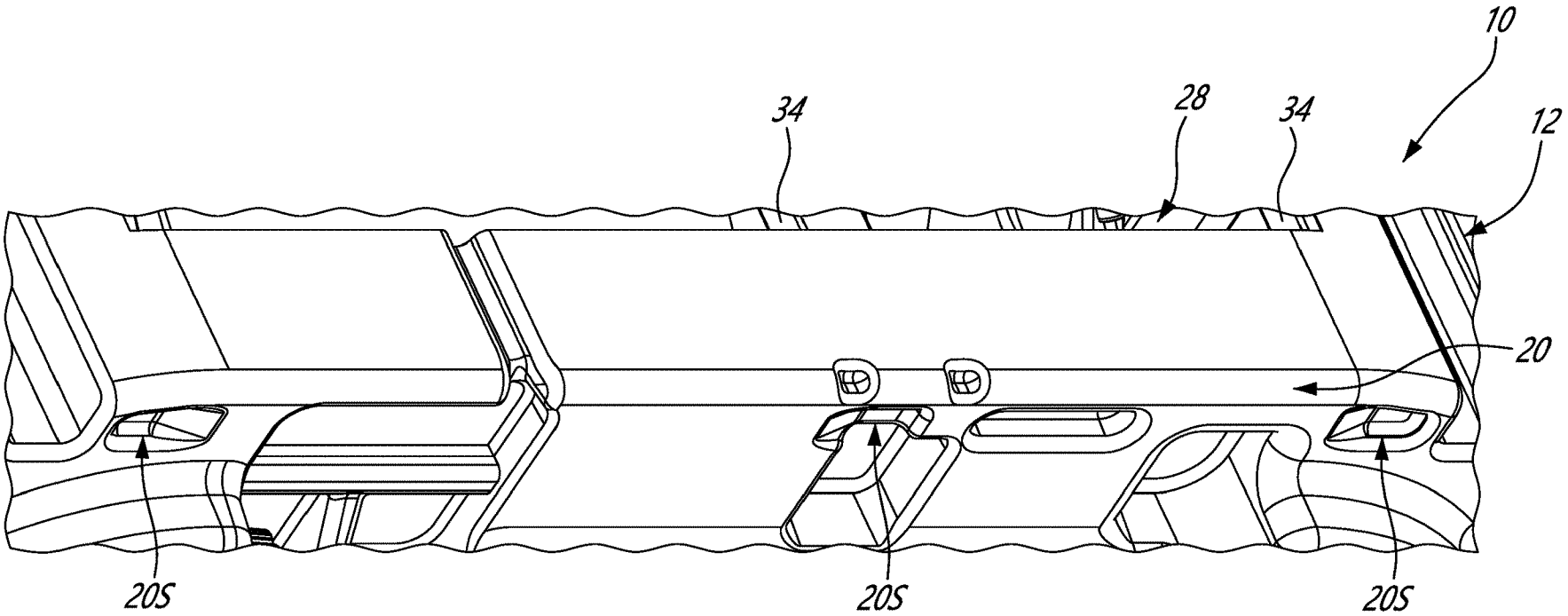
FIG. 8 is an oblique view of a portion of a base of the spa of FIG. 1, viewed from the outside of the spa, showing inwardly protruding seat portions, in accordance to one or more embodiments.
Figure 6:
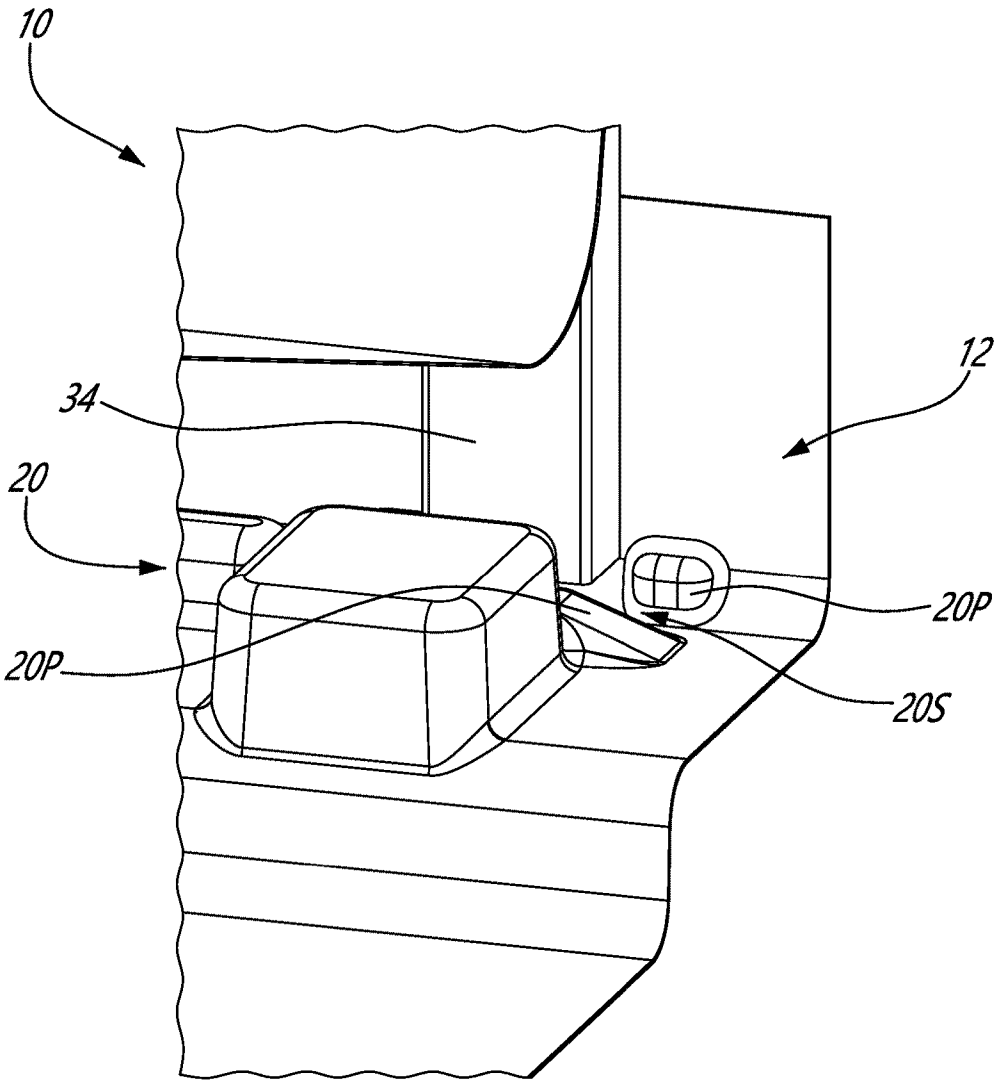

Referring to FIGS. 8 and 9, there is shown seat portions 20S defined in the base 20 of the shell 12 to receive a portion of the strut members 34, and more specially bottom ends of the strut members 34. As shown from underneath the base 20 in FIG. 8, the seat portions 20S are provided in the form of inwardly protruding bulges or pockets also referred as protrusions 20P defined in the shell 12 and extending inwardly towards the cavity 28. Such seat portions 20S may serve as positioning means for the bottom ends of the strut members 34. The seat portions 20S may provide greater stability of the bottom ends of the strut members 34 relative to the base 20, greater local stiffness of the base 20 at the interface between the base 20 and the strut member 34, and/or contribute to a better load distribution from the strut members 34 to the base 20. The seat portions 20S may also better maintain a parallelism between adjacent strut members 34. FIG. 9 shows the seat portion 20S of the strut member 34 extending across the opening 26, viewed from an interior of the cavity 28. As shown, the protrusions 20P are bulge portions of the shell 12 located on at least two sides of the strut member 34 to support and surround at least partially the bottom end thereof. This is an example only, as the seat portions 20S may have a different shape, and/or have more or less protrusions 20P in other embodiments.

Figure 10:
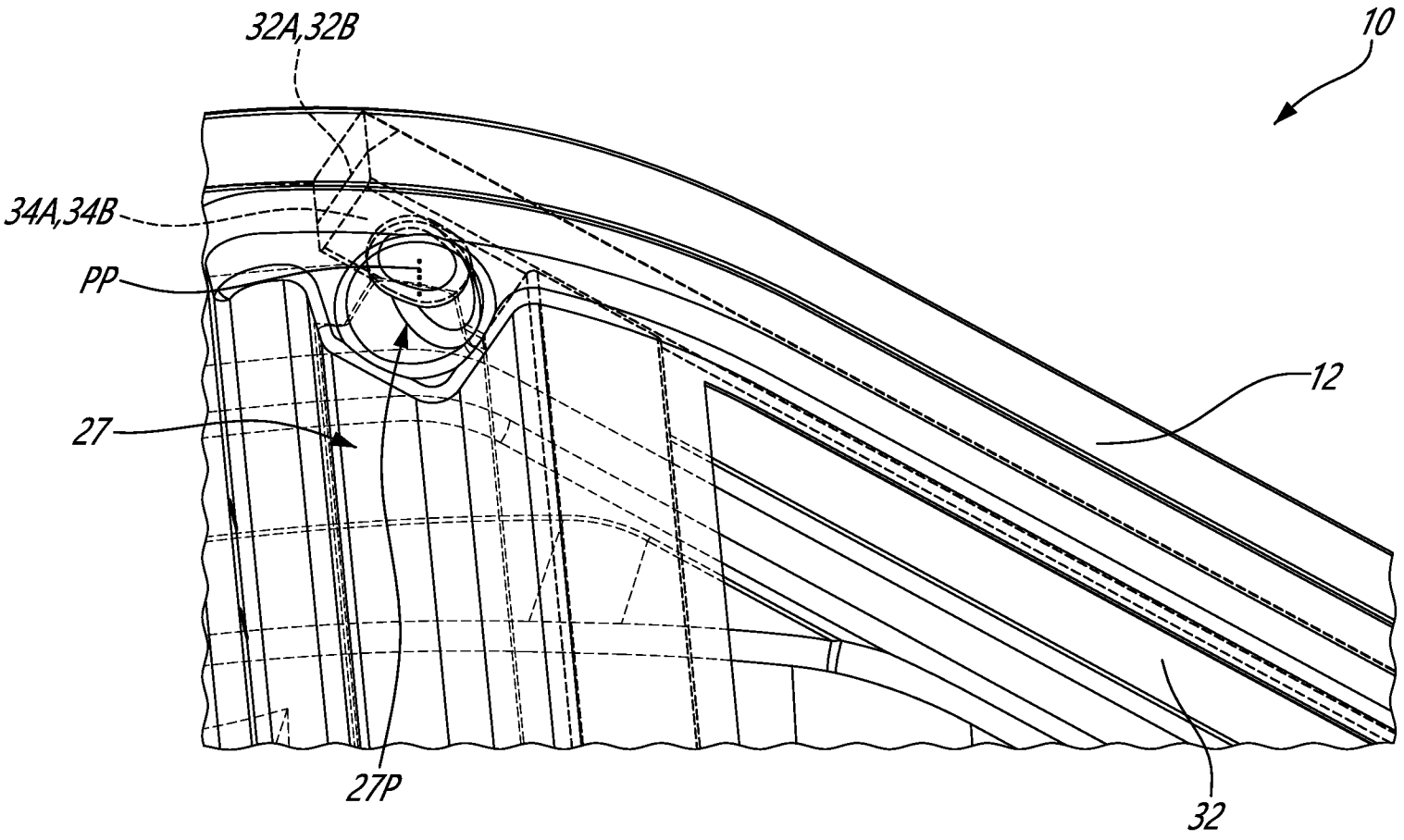
FIG. 10 is an oblique view of a corner portion of the spa of FIG. 1, with transparency applied to features to show a hidden component, in accordance to one or more embodiments.

Referring to FIG. 10, pockets 27P are defined in the shell 12 to receive fasteners to affix the crossbar 32 to the shell 12. Such pockets 27P are located in corner portions 24 of the spa 10 to cooperate with the crossbar 32 adjacent opposite extremities 34A, 34B of the crossbar 32. The pockets 27P are opened to face downwardly. A projection PP extending from an end of the pockets 27P extends within the receding corners 27. The fasteners affixing the crossbar 32 to the shell 12 may thus be recessed so as to be unapparent for a general observer, even if the panels 29 are removed from the side portions 22 of the spa 10. In other embodiments, the crossbar 32 may be a floating crossbar 32, not affixed to the shell 12 and/or only affixed to the strut members 34.

In this embodiment, the crossbar 32 has a constant cross-section along its length. However, in alternate embodiments it can be advantageous for the crossbar 32 to have the beveled ends 32A, 32B previously discussed above. In FIG.

10, the beveled edges 32A, 32B are shown by the cut which would have been made to the crossbar 32. The beveled edges 32A, 32B permit the insertion of the crossbar 32 further into the corner portion 24 of the spa 10, by avoiding that a portion of the opposite extremities 34A, 34B, be subject to undesirable constraints of the curving top portion of the shell 12, while further maintaining its capacity to interface with the pockets 27P of the receding corners 27.

The crossbar 32 and the strut members 34 may be hollowed or plain, have same or different cross-section shape and/or size, depending on the embodiments. Although shown as plain rectangular cross-section beams in this example, they may have alternate cross-sectional shapes, in other embodiments, such as H-shaped cross-sections, I-shaped cross-sections, T-shaped cross-sections, L-shape cross-sections, C-shape cross-sections, U-shaped cross-sections, circularly-shaped cross-sections, pipe-shaped cross-sections, etc. Further, it can be understood that alternate materials to dimensional lumber, such as thermoplastics, plastic composites, composite wood, metal beams, matrix composites, steel, aluminum, etc., can be used without departing from the present disclosure.

There may be additional rigidifying members, interconnecting the crossbar 32 to the strut members 34, such as jambs, couplings, elbows, for example. More than one crossbar 32 per frame 30 may be contemplated in other embodiments. For instance a frame 30 may have a crossbar 32 adapted to be lodged within the rim portion 16, and another crossbar 32 extending along a bottom edge of the opening 26 and/or along the base 20. This may provide even more rigidity to the windowed peripheral wall 18 in at least some embodiments.

As can be understood, the examples described above and illustrated are intended to be exemplary only. The scope is indicated by the appended claims.

What is claimed is:

1. A spa comprising:

a unibody shell having a basin, a rim portion surrounding the basin, a peripheral wall extending from the rim portion, and at least one opening in the peripheral wall, the basin, the rim portion and the peripheral wall defining a cavity therebetween, the at least one opening exposing the cavity; and a frame structurally mounted within the cavity, the frame having a crossbar and a plurality of strut members extending from the crossbar, the crossbar and the plurality of strut members running along respective sides of the at least one opening, the plurality of strut members each being affixed to the unibody shell at locations distributed about the at least one opening.

2. The spa of claim 1, wherein first and second ones of the plurality of strut members are each extending from the crossbar at a respective one of first and second extremities of the crossbar.

3. The spa of claim 1, wherein the plurality of strut members include a middle strut member running across the at least one opening.

4. The spa of claim 1, wherein the at least one opening includes a plurality of openings, the frame including a plurality of frames decoupled from one another, each one of the plurality of frames being structurally mounted within the cavity via a corresponding one of the plurality of openings.

5. The spa of claim 1, wherein the crossbar has two opposite longitudinal extremities each having a beveled end.

6. The spa of claim 1, wherein the crossbar is abutted against an inner surface of the rim portion of the unibody shell.

7. The spa of claim 1, wherein the at least one opening defines first and second lateral edges in the peripheral wall, the plurality of strut members having first and second strut members being each outwardly offset away from a corresponding one of the two lateral edges of the peripheral wall.

8. The spa of claim 1, wherein the peripheral wall has a side portion, and corner portions formed on each lateral side of the side portion, the at least one opening being located within the side portion.

9. The spa of claim 8, wherein the side portion is between 2 to 5 times a lateral dimension of one of the corner portions.

10. The spa of claim 8 wherein each corner portion has a receding corner receding inwardly towards the cavity and extending vertically parallel to a height of the opening.

11. The spa of claim 10, further comprising a panel engaged with the receding corners on each lateral side of the opening, the panel covering the at least one opening.

12. The spa of claim 1, wherein the at least one opening has a lateral dimension ranging between about 50% and about 90% of one of a width and a length of the spa.

13. The spa of claim 1, the unibody shell has a base further defining the cavity, the base having at least one seat portion for receiving a portion of one of the plurality of strut members.

14. The spa of claim 13, wherein the at least one seat portion is provided in the form of an inwardly protruding bulge extending within the cavity.

15. The spa of claim 1, wherein the unibody shell has a plurality of inwardly protruding pockets configured to abut against at least one of the crossbar and one of the plurality of strut members.

* * * * *